United States Patent [19]

Lucke

[11] 4,403,366

[45] Sep. 13, 1983

[54] TOWEL AND MOUNTING METHOD AND MEANS

[76] Inventor: Harold J. Lucke, 930 Crestview Dr., Millbrae, Calif. 94030

[21] Appl. No.: 302,676

[22] Filed: Sep. 15, 1981

[51] Int. Cl.[3] ..... A44B 21/00; A47K 10/02

[52] U.S. Cl. ..... 15/209 R; 24/204; 24/306

[58] Field of Search ..... 15/208, 209 R, 210 R; 24/7, 306, 204; 224/901

[56] References Cited

U.S. PATENT DOCUMENTS

| | | | |
|---|---|---|---|
| 2,968,825 | 1/1961 | Wetherby | 15/210 R X |
| 3,040,357 | 6/1962 | Belleni | 15/209 |
| 3,063,718 | 11/1962 | Steinkamp | 273/55 |
| 3,235,926 | 2/1966 | Mates | 24/204 X |
| 3,453,696 | 7/1969 | Mates | 24/204 X |
| 3,760,461 | 9/1973 | Wright | 24/7 |
| 4,140,253 | 2/1979 | Vickers et al. | 24/204 X |
| 4,224,712 | 9/1980 | Black et al. | 15/209 |

FOREIGN PATENT DOCUMENTS

| | | | |
|---|---|---|---|
| 206334 | 11/1923 | United Kingdom | 15/209 R |

*Primary Examiner*—Edward L. Roberts

*Attorney, Agent, or Firm*—Robert W. Dilts

[57] ABSTRACT

A removable towel means for mounting on the belt, pants, or accessories worn by or in the possession of the user. The towel means includes a support member and a length of toweling which are quickly and easily attached to each other by manual pressure and separated from each other by manual pulling. The support member is made of solid material in the form of a clip and has a gripping means including a strip of fabric with projecting hooking elements affixed thereto. The length of toweling forms an integral pocket and has a receiving means including a strip of fabric with exposed loop elements affixed thereto for removably receiving the hook elements of the gripping means on the support member.

2 Claims, 5 Drawing Figures

TOWEL AND MOUNTING METHOD AND MEANS

BACKGROUND OF THE INVENTION

This invention relates to a towel which may be quickly and easily attached to and removed from the users person and more particularly to the combination of a towel and a support member therefor which are easily and quickly attached to or removed from each other, the support member being adapted for removable mounting to a persons clothing or accessories and the towel providing an integral large pocket.

This invention is particularly useful to persons participating in sports such as golf or tennis where such persons may need immediate access at various times and places to a freely movable towel to clean or dry portions of their body or playing equipment as well as an extra large pocket for holding playing equipment. It has been proposed in the prior art to attach a towel to the clothing of an athlete by means of self-adhering fabric strips of the type sold under the trademark VELCRO comprising a receiver strip including a backing fabric having a plurality of flexible loop elements or one side thereof and a gripping strip including a backing fabric having a plurality of flexible hooking elements on one side thereof. However, both the towel and the clothing of an athlete must be washed frequently and thus, in the prior art, the gripping strip of the above mentioned attachment means tended to be fouled by lint, for example, and its adhering properties ruined after a few washings. Furthermore, the use of the above mentioned attachment means according to the prior art required the wearing of specially made or modified clothing.

It is a primary object of this invention to overcome the above mentioned and other shortcomings of the prior art.

A further object of this invention is a method and means providing a towel having an integral large pocket as well as removable attachment of the towel to the clothing of the user.

SUMMARY OF THE INVENTION

According to this invention, a removable towel means for mounting on the clothing, accessories or the like of a user is provided including a support made of solid material which is adapted to be mounted on such clothing, accessories or the like of the user against removal by manual forces exerted thereon in outward and downward directions only. A gripping means is rigidly affixed to the support member and a receiver means is rigidly affixed to a length of toweling having side and end edges. The gripping means includes a backing strip having a plurality of exposed flexible hooking elements on the free side thereof and the receiver means includes a fabric backing strip having a plurality of flexible loop elements on the free side thereof adapted to receive and hold the plurality of hooking elements of the gripping means when applied thereto under manual pressure and to be disengaged therefrom by manual pulling of the toweling in outward and downward directions. The towel is preferably folded to bring its side edges into alignment and a double fold made in the towel intermediate its ends. Stitching of the towel to form a hem at its side edges extending from one of its ends to capture said double folds forms an integral large pocket therein.

BRIEF DESCRIPTION OF THE DRAWING

This invention will be more fully understood from the following detailed description of the preferred embodiment thereof when read in conjunction with the appended drawing wherein.

DETAILED DESCRIPTION OF THE PREFERRED EMBODIMENT

Figure 1:
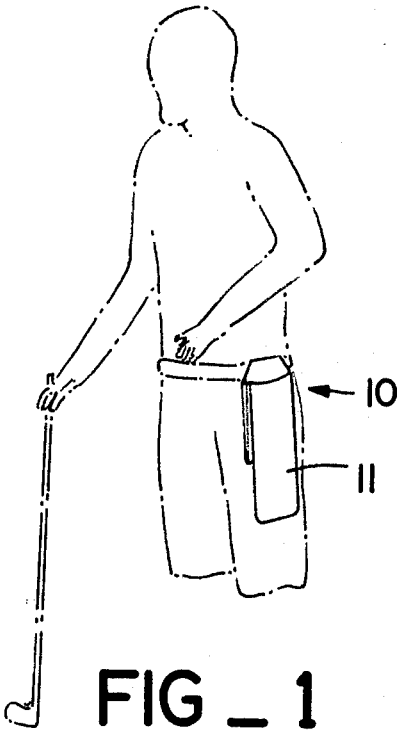
FIG. 1 is a perspective view of the preferred embodiment of applicant's removable towel means mounted at the waistband of a user shown in phantom.

Referring to FIG. 1, a removable towel means providing an enlarged integral pocket according to the preferred embodiment of this invention is shown mounted on the waistband at the left side of the user. According to the teaching of this invention, the removable towel means 10 may be mounted on a conventional belt normally worn by the user or on the waistband of the pants normally worn by the user without any modification thereof. Furthermore, the removable towel means 10 according to the teaching of this invention may be worn on the rear pocket, for example, of the pants of the user or on an accessory normally worn by, or in the possession of, the user having a vertically extending generally planar wall portion similar to a belt waistband or pocket.

Figure 2:
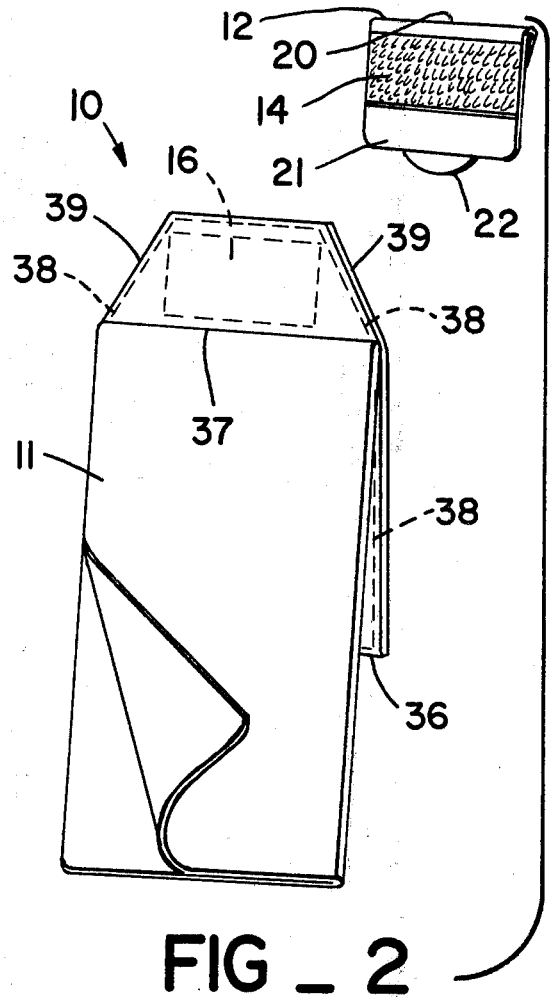
FIG. 2 is an exploded view showing the towel and support member of the preferred embodiment of applicant's invention in perspective.

Referring to FIG. 2, the removable towel means 10 according to the teaching of applicant's invention, comprises a length of toweling 11 and a support member 12 made of solid material such as plastic or metal, for example. Means are provided by which the toweling 11 and support member 12 may be quickly and easily attached to each other by manual pressure and separated from each other by manual pulling. In the preferred embodiment of this invention, an attachment means of the type commercially available under the trademark VELCRO is used. Thus, a gripping means 14 including a fabric backing strip having a plurality of exposed flexible hooking elements projecting from one side thereof is rigidly fixed to the support member as by having its other side glued, for example, to a surface of the support member 12 which is exposed in use. A receiver means 16, including a fabric backing strip having a plurality of flexible loop elements on one side thereof adapted to receive and hold the plurality of flexible hooking elements of the gripping means 14 may be sewed or otherwise rigidly affixed to one side of the length of toweling 11.

Figure 3:
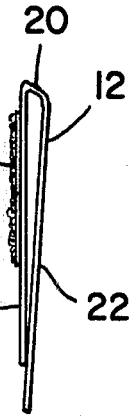
FIG. 3 is an enlarged side view in elevation of the support member of FIG. 2.

Referring to FIG. 3, the support member 12 according to the preferred embodiment of this invention, is a thin, flat plate-like member formed into a generally U-shaped clip having a bight 20 and converging legs 21 and 22 in side view. The gripping means 14 is rigidly affixed to the exterior surface of one of the legs 21 and the other leg 22 may be shaped to facilitate its insertion between the belt or waistband and the body, for example, of the user. The support member 12 is made of relatively resilient material and the bight 20 may be made large enough so that a wall member of substantial thickness may be received between the legs 21 and 22. Thus, the support member 12 could be mounted on a wall portion of a purse, golf bag, or other accessory worn by or in the possession of the user.

Figure 4:
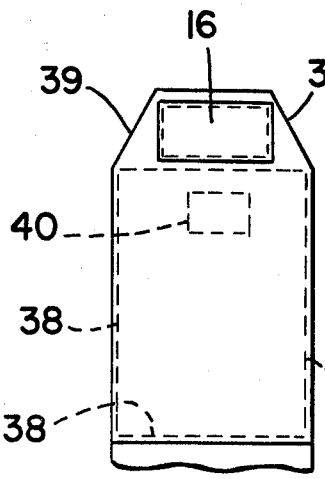
FIG. 4 is a reduced fragmentary rear view in elevation of the towel of FIG. 2.

Referring to FIG. 4, the receiver means 16 according to the preferred embodiment of this invention may be stitched to one side of a length of toweling having side and end edges adjacent one end edge thereof. It will be understood that in use, the support member 12 would be clipped relatively rigidly to the belt, waistband, pocket, or other accessory worn by or in the possession of the user and the toweling 11 would be removably attached thereto by pressing the receiver means 16 on the toweling against the gripping means 14 on the support member 12. The hands or playing equipment of the user may then be cleaned or dried by rubbing them on the toweling 11 without removing the toweling from the support member 12. More importantly, the toweling 11 may be quickly and easily stripped from the support member to enable the face, neck or arms of the user to be dried and then the toweling may be quickly and easily reattached to the support member 12.

After use, the toweling 11 may be removed from the support member for washing. Since the support member 12 is made of a solid material such as plastic or metal, it will not require washing. Thus, it is important that the gripping means 14 be attached to the support member 12 and the receiving means 16 be attached to the toweling 11. This is because the gripping means 14 would tend to be fouled by lint, for example, when it is washed, thus rendering it inoperative in subsequent use, whereas the receiving means 16 may be washed repeatedly without affecting its subsequent attachment functions.

Figure 5:
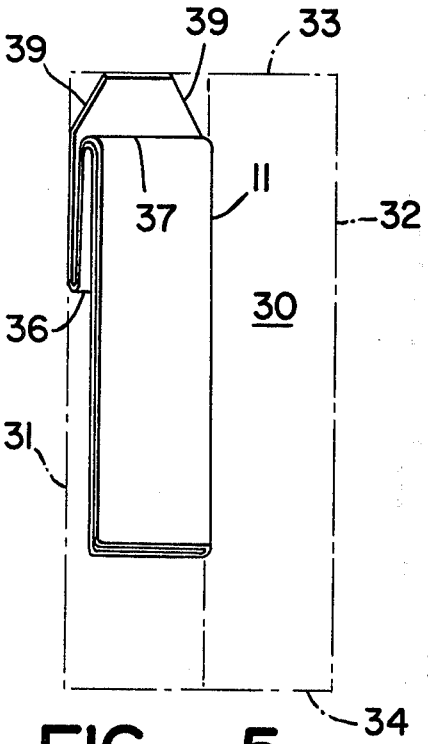
FIG. 5 is a reduced view partially in phantom and partially in perspective illustrating certain steps in the method of making the towel according to the preferred embodiment of applicant's invention.

According to the preferred embodiment of this invention, the towel 11 is made from a rectangular length 30 of toweling having side edges 31 and 32 and end edges 33 and 34 as shown in phantom in FIG. 5. The toweling is first folded along its elongated central axis to align the side edges 31 and 32 with each other with the overlapping portions of the end edges 33 and 34 being also maintained in alignment. One end portion of the toweling is then folded twice transversely of the elongated dimension thereof to form a double fold as shown at 36 and 37 in FIGS. 2 and 5. The transversely folded end portion of the toweling 30 may then be stitched as indicated by the reference numeral 38 in FIGS. 2 and 4 at least along the aligned edges 31 and 32 to form a hem capturing the double fold 36 and 37, thereby forming an integral pocket in the towel 11. The hem provided by the stitching 38 may extend across the end and down the folded side of the towel 11 as shown in FIGS. 2 and 4. However, the end portion of the folded toweling 30 which is not transversely folded is preferably left without stitching, thereby providing a double ply free end portion in the towel 11 to facilitate its cleaning and drying functions.

In the preferred embodiment of this invention, the corners of the towel 11 at its transversely folded end may be removed to provide inwardly tapered edges 39 forming a tab portion. The receiving means 16 is preferably rigidly fixed to the rear surface of such tab portion opposite the surface forming the integral pocket.

As indicated in phantom by the reference numeral 40 in FIG. 4, a further receiving means and a further gripping means may be provided on opposed internal surfaces of the integral pocket adjacent its opening. It will be understood that the length of toweling 30 is dimensioned so that when it has been folded and stitched, the integral pocket formed as described above will be large enough to receive a number of golf balls and golf tees or a tennis ball or two for the convenience of the user. The gripping means and receiving means 40 affixed to opposed interior surfaces of the integral pocket will prevent inadvertent dislodgement of such balls from the integral pocket during violent activity of the user or use of the towel for cleaning and drying purposes. Since the receiving means and gripping means 40 in the interior of the integral pocket may be engaged with each other during washing of the towel 11, such gripping means will be protected against fouling by lint and the like.

It is believed that those skilled in the art will make obvious modifications in the preferred embodiment of this invention shown in the drawing and described hereinabove without departing from the scope of the following claims. For example, the toweling may be made of cotton, wool, plastic, etcetera, in terry cloth, muslin, flannel or other absorbent form. The size and formation of the towel and clip may be varied to accommodate the needs of men, women or children and to provide a pocket width and depth suitable for use in various sports such as tennis, golf, handball, racquetball, bowling, bicycling, jogging, fishing, or hunting and the like. The pocket may be lined with a durable material such as denim, canvas, plastic or the like. The pocket could be closed by a snap, zipper or flap with or without a button. In addition to plastic and metal, the clip could be made of wood or any other suitable solid material that will not crack, break or cause injury or allergic reaction in use. Any attachment of the towel to the clip may be used which is equivalent to the means described in that it must be impossible to injure the clothes, accessories or person of the user in removing the towel from the clip when mounted thereon.

What is claimed is:

1. A removable towel means for mounting on the clothing, accessories or the like of a user comprising in combination:

(a) a support member comprising a thin flat plate member made of solid material and formed into a U-shaped clip having a bight portion and converging legs in side view adapted to be mounted on said clothing, accessories or the like of said user against removal by manual forces exerted thereon in outward and downward directions only;

(b) a gripping means rigidly affixed to the exterior surface of one of said legs of said support member and including a fabric backing strip having a plurality of exposed flexible hooking elements on the free side thereof projecting from said support member when said support member is mounted on the clothing, accessories or the like of the user, (c) a length of toweling having side and end edges including an integral packet formed therein, and (d) a receiver means rigidly affixed to said length of toweling and including a fabric backing strip having a plurality of flexible loop elements on the free side thereof adapted to receive and hold said plurality of flexible hooking elements of said gripping means when applied thereto under manual pressure, said gripping means being adapted to be disengaged from said receiving means by manual pulling in outward and downward direction, (e) wherein a gripping means including a plurality of projecting flexible hooking elements is affixed to one interior surface of said integral pocket adjacent the opening thereof and a receiving means including a plurality of flexible loop elements adapted to receive said hooking elements is affixed to the other interior surface of said integral pocket in opposition to said gripping means.

2. A removable towel means for mounting on the clothing, accessories or the like of a user comprising in combination:

(a) a support member comprising a thin flat plate member made of solid material and formed into a U-shaped clip having a bight portion and converging legs in side view adapted to be mounted on said clothing, accessories or the like of said user against removal by manual forces exerted thereon in outward and downward directions only;

(b) a gripping means rigidly affixed to the exterior surface of one of said legs of said support member and including a fabric backig strip having a plurality of exposed flexible hooking elements on the free side thereof projecting from said support member when said support member is mounted on the clothing, accessories or the like of the user, (c) a length of toweling having side and end edges including an integral pocket formed therein, and (d) a receiver means rigidly affixed to said length of toweling and including a fabric backing strip having a plurality of flexible loop elements on the free side thereof adapted to receive and hold said plurality of flexible hooking elements of said gripping means when applied thereto under manual pressure, said gripping means being adapted to be disengaged from said receiving means by manual pulling in outward and downward direction, (e) wherein said length of toweling is generally rectangular and is folded along its central elongated axis to bring said side edges into overlying alignment, one end portion of said folded toweling being folded twice transversely of the elongated dimension thereof and hemmed in folded position to form said integral pocket.

* * * * *